US009598261B2

(12) United States Patent
Barea

(10) Patent No.: US 9,598,261 B2
(45) Date of Patent: Mar. 21, 2017

(54) METHOD AND DEVICE FOR STORING YARN IN ORDER TO FEED THREAD WITHOUT CREATING TWISTING THEREOF

(71) Applicant: BTSR INTERNATIONAL S.P.A., Olgiate Olona (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 309 days.

(21) Appl. No.: 14/354,211

(22) PCT Filed: Dec. 12, 2012

(86) PCT No.: PCT/IB2012/002731
§ 371 (c)(1),
(2) Date: Apr. 25, 2014

(87) PCT Pub. No.: WO2013/093592
PCT Pub. Date: Jun. 27, 2013

(65) Prior Publication Data

US 2014/0299703 A1 Oct. 9, 2014

(30) Foreign Application Priority Data

Dec. 23, 2011 (IT) ..... MI2011A002369

(51) Int. Cl.
*B65H 51/30* (2006.01)
*D03D 47/36* (2006.01)
(Continued)

(52) U.S. Cl.
CPC ..... *B65H 51/30* (2013.01); *B65H 51/22* (2013.01); *D03D 47/361* (2013.01); *D04B 15/486* (2013.01); *B65H 2701/31* (2013.01)

(58) Field of Classification Search
CPC ..... D04B 15/486
(Continued)

(56) References Cited

U.S. PATENT DOCUMENTS 3,637,149 A 1/1972 Frei
3,796,385 A 3/1974 Jacobsson
(Continued)

FOREIGN PATENT DOCUMENTS

CN 2055143 U 3/1990
CN 2056161 U 4/1990
(Continued)

OTHER PUBLICATIONS

Chinese Office Action dated Sep. 6, 2015 and Chinese Search Report in corresponding Chinese patent application No. 201280064043.5.
(Continued)

*Primary Examiner* — William E Dondero
(74) *Attorney, Agent, or Firm* — Vorys, Sater, Seymour and Pease LLP

(57) ABSTRACT

A method for supplying a thread to a textile machine without creating torsions thereof includes picking up the thread from a reel, winding it on a rotary drum driven by an electric motor thereof and supplying such thread to the textile machine, preferably at constant tension and/or quantity. The method provides for measuring the amount of thread leaving the rotary drum and the amount of thread wound thereon and intervening on the rotation of such drum so the amount of thread leaving the drum is equivalent to the amount loaded thereon to avoid the creation of torsion on the thread.
A device for implementing such method is also disclosed.

14 Claims, 4 Drawing Sheets

(51) Int. Cl.
*B65H 51/22* (2006.01)
*D04B 15/48* (2006.01)

(58) Field of Classification Search
USPC ..... 242/364.7, 364.8
See application file for complete search history.

(56) References Cited

U.S. PATENT DOCUMENTS

| | | | | |
|---|---|---|---|---|
| 3,843,069 | A | 10/1974 | Deniega et al. | |
| 3,883,083 | A | 5/1975 | Rosen | |
| 4,180,215 | A | 12/1979 | Nurk | |
| 4,852,617 | A | 8/1989 | Hamer et al. | |
| 5,240,194 | A | 8/1993 | Noirot et al. | |
| 5,421,534 | A | 6/1995 | Arnold et al. | |
| 5,590,547 | A * | 1/1997 | Conzelmann | D04B 15/486 139/452 |
| 2008/0210804 | A1 | 9/2008 | Barea | |
| 2008/0296425 | A1 | 12/2008 | Comotto et al. | |
| 2009/0057464 | A1* | 3/2009 | Gotti | B65H 59/10 242/365.4 |
| 2009/0178757 | A1 | 7/2009 | Cocovi et al. | |
| 2011/0000306 | A1 | 1/2011 | Zenoni et al. | |
| 2012/0037601 | A1 | 2/2012 | Watanabe et al. | |

FOREIGN PATENT DOCUMENTS

| | | | |
|---|---|---|---|
| CN | 1046766 | A | 11/1990 |
| CN | 1208781 | A | 2/1999 |
| CN | 1635976 | A | 7/2005 |
| CN | 101563489 | A | 10/2009 |
| DE | 4104087 | A1 | 8/1991 |
| DE | 4313255 | A1 | 10/1994 |
| DE | 102004020465 | B3 | 9/2005 |
| EP | 0424770 | A2 | 5/1991 |
| EP | 0652312 | A1 | 5/1995 |
| EP | 2014809 | A1 | 1/2009 |
| EP | 2031610 | A1 | 3/2009 |
| EP | 1432635 | B1 | 5/2009 |
| FR | 2655888 | A1 | 6/1991 |
| GB | 1390053 | A | 4/1975 |
| JP | S49-7551 | A | 1/1974 |
| JP | 2011-012381 | A | 1/2011 |
| WO | 2006133662 | A1 | 12/2006 |
| WO | 2007006411 | A1 | 1/2007 |
| WO | 2007048528 | A1 | 5/2007 |
| WO | 2007096765 | A1 | 8/2007 |
| WO | 2008055571 | A1 | 5/2008 |
| WO | 2010116412 | A1 | 10/2010 |
| WO | 2013/064879 | A1 | 5/2013 |
| WO | 2013/072736 | A1 | 5/2013 |
| WO | 2013/088233 | A1 | 6/2013 |
| WO | 2013/098631 | A1 | 7/2013 |

OTHER PUBLICATIONS

U.S. Appl. No. 14/353,728 to Tiziano Barea, "Positive Feeder Device for Feeding Metal Wires at Constant Tension," filed Apr. 23, 2014. (US National Stage of WO 2013/064879 A1).

U.S. Appl. No. 14/353,806 to Tiziano Barea, "Yarn Feeder of Storage Type With Magnetic Brake," filed Apr. 24, 2014. (US National Stage of WO 2013/072736 A1).

U.S. Appl. No. 14/353,867 to Tiziano Barea, "Device for Feeding Yarn to a Textile Machine," filed Apr. 24, 2014. (US National Stage of WO 2013/088233 A1).

U.S. Appl. No. 14/354,279 to Tiziano Barea, "System and Method for Feeding Metal Wires at Constant Tension," filed Apr. 25, 2014. (US National Stage of WO 2013/098631 A1).

International Search Report mailed Feb. 27, 2013 for PCT/IB2012/002731 to BTSR International S.P.A. filed Dec. 12, 2012.

Japanese Office Action dated May 19, 2015 in corresponding Japanese patent application No. 2014-543991.

* cited by examiner

METHOD AND DEVICE FOR STORING YARN IN ORDER TO FEED THREAD WITHOUT CREATING TWISTING THEREOF

CROSS-REFERENCE TO RELATED APPLICATIONS

This is a §371 National Stage Application of International Application No. PCT/IB2012/002731 filed on 12 Dec. 2012, claiming the priority of Italian Patent Application No. MI2011A002369 filed on 23 Dec. 2011.

A method and a device for supplying a thread to a textile machine, according to the present invention.

With particular reference to the thread accumulation suppliers, also referred to as negative suppliers, they are generally of two types: fixed drum suppliers and rotary drum suppliers. In the first case the supplier provides for a fixed drum around which an external rotary member loads a given amount of thread or yarn, creating on such drum a reserve of said thread that the textile machine picks up depending on the production needs thereof. In the second case instead the supplier comprises a member or rotary drum which picks up the thread or yarn from a bobbin or reel, said yarn or thread creating on such drum (which rotates, around a longitudinal axis thereof and driven by an actuator thereof) a thread reserve which is then picked up by a textile machine depending on the production needs of the latter.

Positive suppliers instead always comprise the rotary drum, but provide the thread to the textile machine as a function of a demand of the latter.

In both cases, the supplier (negative or positive) comprises a control unit which in the case of accumulation suppliers controls the rotation of the drum or of the loading member so as to pick up the thread from the reel to maintain the amount of thread deposited on the drum comprised between a minimum reserve value and a maximum reserve value, while in the case of positive suppliers it controls the rotation of the drum which directly feeds the thread to the textile machine.

Lastly, the suppliers of the aforementioned type may have known means for controlling the amount of thread supplied to the machine, the amount of thread accumulated on the drum and for controlling and thus regulating the tension of the thread supplied to such machine.

Both the known types of accumulation suppliers of the prior art (fixed rotary drums and positive or negative rotary drum suppliers) reveal the limit of creating torsions or twistings on the thread being supplied, torsions which are generated due to the normal difference of speed between the thread picked up by the machine and the speed of the thread loaded on the drum. Obviously the greater the difference between such speed, the greater the torsions created on the thread, these torsions thus ending summed up to or removed from the possible torsions previously present on the thread (for example twisted thread), thus varying the natural characteristics thereof.

Thus a textile machine provided with such type of accumulation suppliers produces a potentially defective garment due to the transformation that the thread (varying the number of torsions thereof) was subjected to during the supply step. The transformation of the number of torsions, in particular of a thin thread, may also lead to weakening (mechanical resistance) of the thread, causing the breakage thereof during the production.

An object of the present invention is to provide an accumulation supply method and device which allow supplying threads or yarns to a textile machine that are not subjected to torsion upon exit from such device.

In particular, an object of the invention is to provide a method and a device capable of guaranteeing the absence of such torsion and allow producing defect-free products.

Another object is to provide a method and a device of the aforementioned type that are of reliable implementation and use.

Another object is to provide a device that is capable of operating, without creating torsion of the thread, with direction of rotation regardless of the type of yarn used, whether of the left torsion s or right torsion z type.

These and other objects apparent to the man skilled in the art are attained by a method and a supply device according to the attached claim.

For a better understanding of the present invention the following drawings are attached herein purely by way of non-limiting example, wherein.

Figure 2:
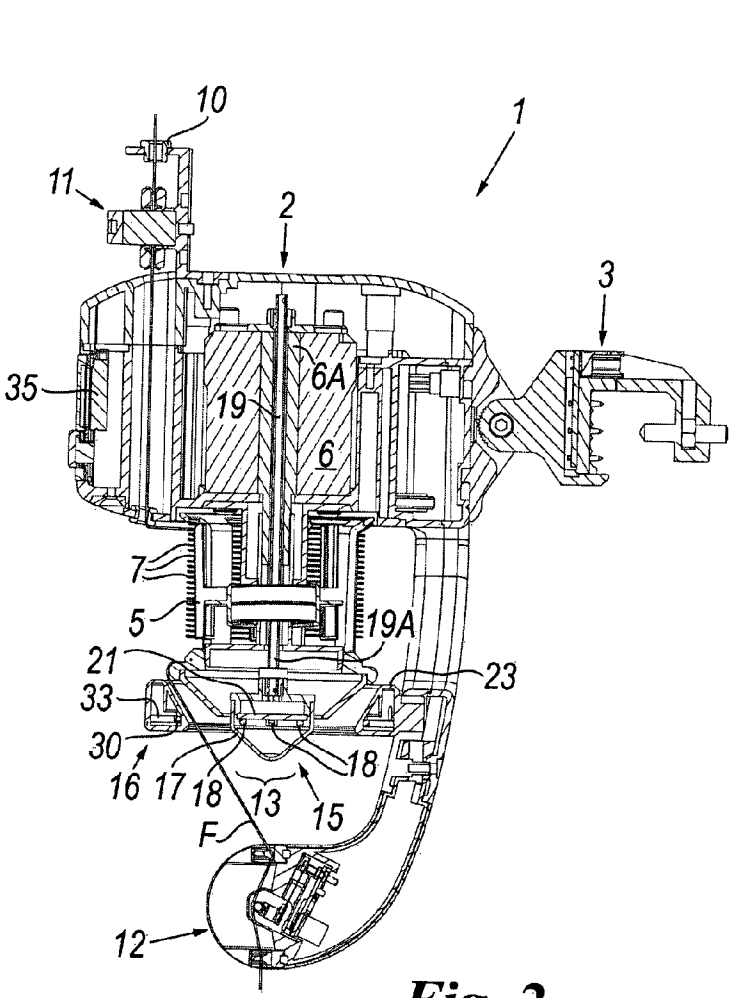
FIG. 2 shows a sectional view according to line 2-2 of FIG. 2.
Figure 1:
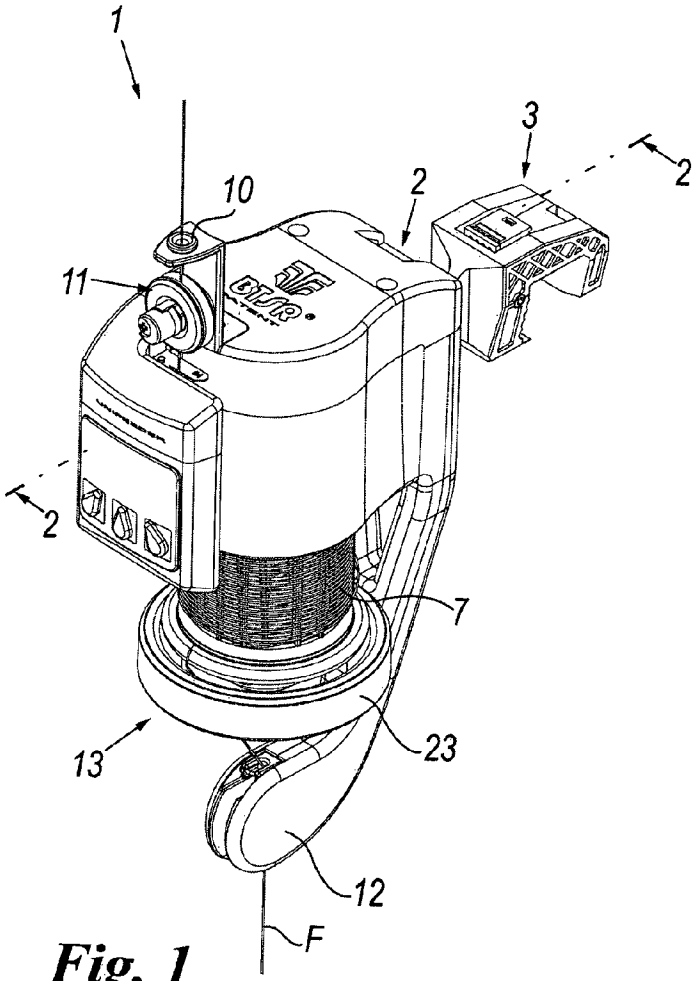
FIG. 1 shows a perspective view of a device provided according to the invention.

With reference to the aforementioned figures, a supply device according to the invention is generally indicated with 1 and comprises a body 2 provided with a fixed bracket 3 adapted to allow the constraint of the device to a support (not shown) associated to a textile machine 100 (shown schematically in FIG. 3) or proximal to the latter.

The body 2 carries a member or rotary drum 5 driven (in any known manner) by a motor or electrical actuator 6 (with hollow shaft 6A) thereof contained in the body 2. On such drum there is wound a thread F before exiting from the supply device and reaching the textile machine 100; the thread F forms a plurality of turns 7 on the drum 5 so as to define a thread "reserve" for the machine so as to always allow an optimal operation even in presence of considerable pick up discontinuity by such machine for the production of a particular product (for example a jersey).

The thread F entering the device 1 cooperates with one or more thread guides 10 (only one shown in the figures), for example made of ceramic material, which defines the input trajectory thereof in said device so as to prevent the thread F from coming into contact with the body 2 thus being damaged.

The supply device 1 preferably has a thread braking member 11 in input and a tension sensor 12, of the per se known type and thus not described. The thread guide 10 and the braking member 11 project from the body 2.

Figure 4:
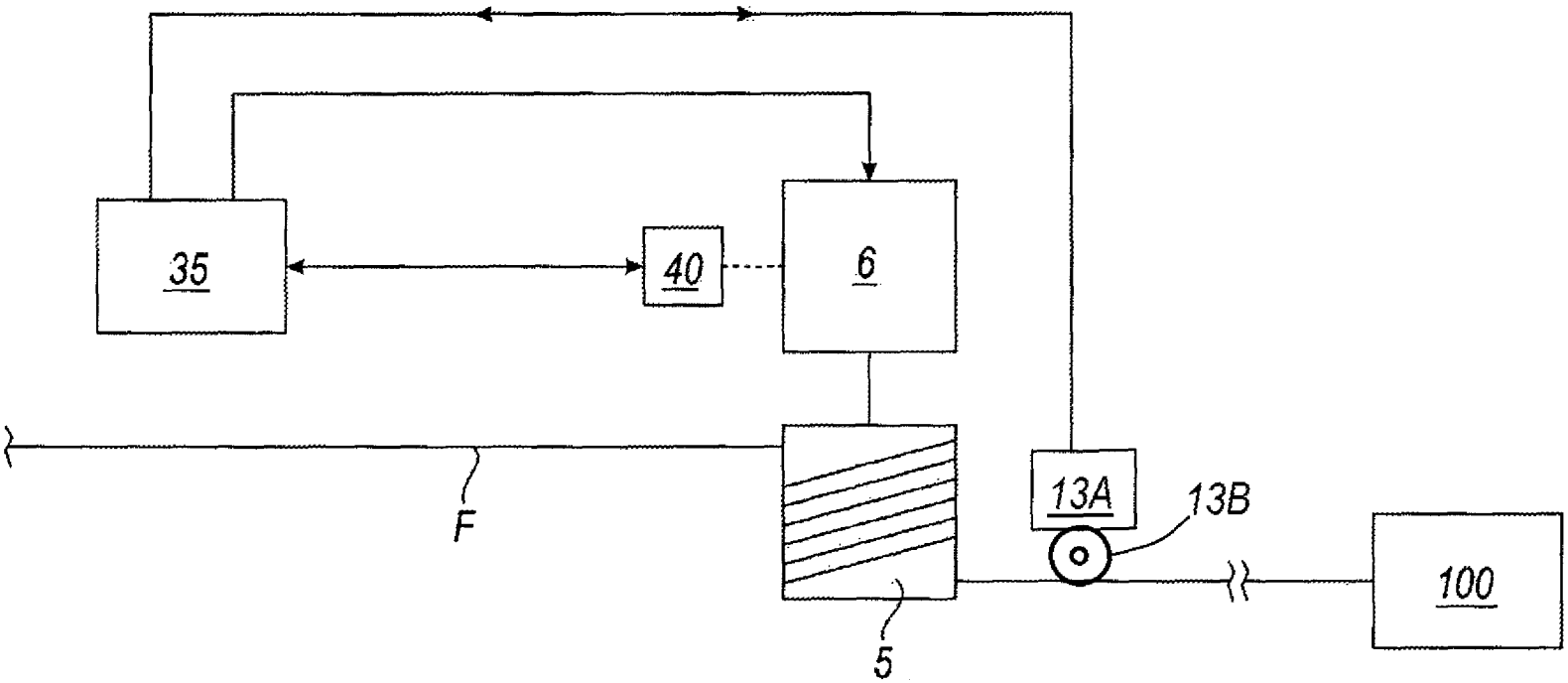
FIG. 4 shows a block diagram of a second embodiment of a supply device according to the invention.
Figure 5:
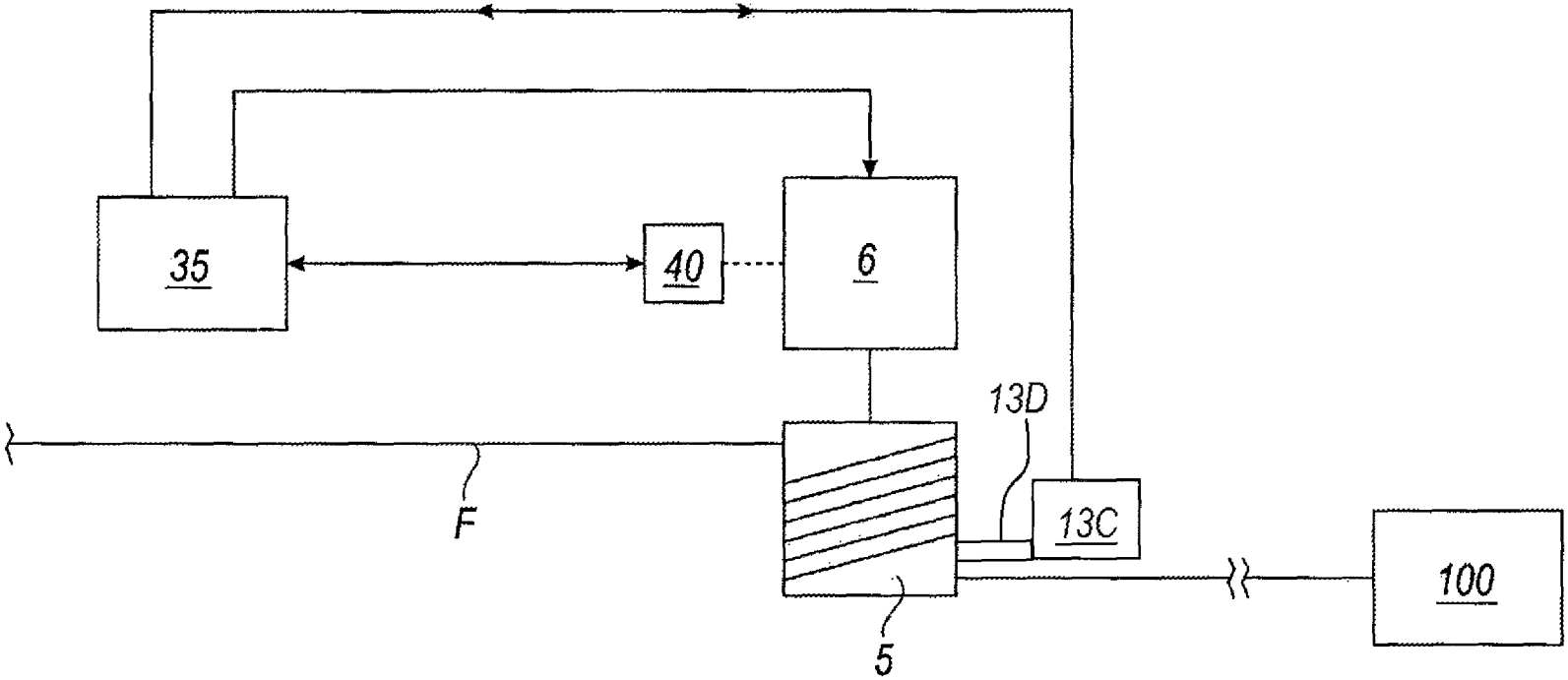
FIG. 5 shows a block diagram of a third embodiment of a supply device ; and according to the invention.

The supplier 1, in the embodiment of the figures, has an optical sensor 13 adapted to measure without contact the amount of the thread F picked up by the textile machine. This according to what is described in Italian patent application no. MI2011A002046 in the name of the same Applicant. Alternatively, the amount of thread F leaving the rotary drum may be measured using mechanical detector means 13A (FIG. 4) (for example, including a wheel 13B or the like) which directly contacts the thread and/or mechanical detector means 13C (FIG. 5) (for example, including a wheel 13D or the like) which directly contacts the rotary drum 5, such that the thread cooperates indirectly, at contact, or always without contact with correlation sensors.

The sensor 13 comprises a first part 15 and a second part 16 surrounding the first; such first part is defined by a body 17 (totally or partially, for example in a lateral surface thereof 22, made of material transparent to light, of any known type), arranged coaxially to the rotary drum 5 and containing a plurality of light emitting members or transmitter photodiodes 18. The body is supported by the body 2 through a "straw" 19 arranged inside the hollow shaft 6A and fixed to an end 18A thereof by such body. Within the "straw" there passes the wire for the management of the required signals sent and received by the sensor 13.

The photodiodes 18 are associated to an electronic circuit or electronic card 21 contained in the body 17 which is present in stationary position at an end of the drum 5 from which the thread F is detached for reaching to the textile machine.

The second part 16 of the sensor 13, also stationary, is defined by a hollow annular body 23 fixed to the body 2. Such body 23 comprises at least one transparent portion faced to the first part 15 and which contains a plurality of receiver photodiodes 30, in a number equivalent to that of the transmitter photodiodes 18 and arranged within such part 16 so as to receive the light signals emitted by the corresponding transmitter 18 (for example so as to face such emitters).

Also such receivers 30 are associated to a circuit or electronic card 33 inserted in the part 16 and electrically connected, like the circuit 21, to a control unit 35 of the device 1 which supervises the operation of the supplier.

Figure 3:
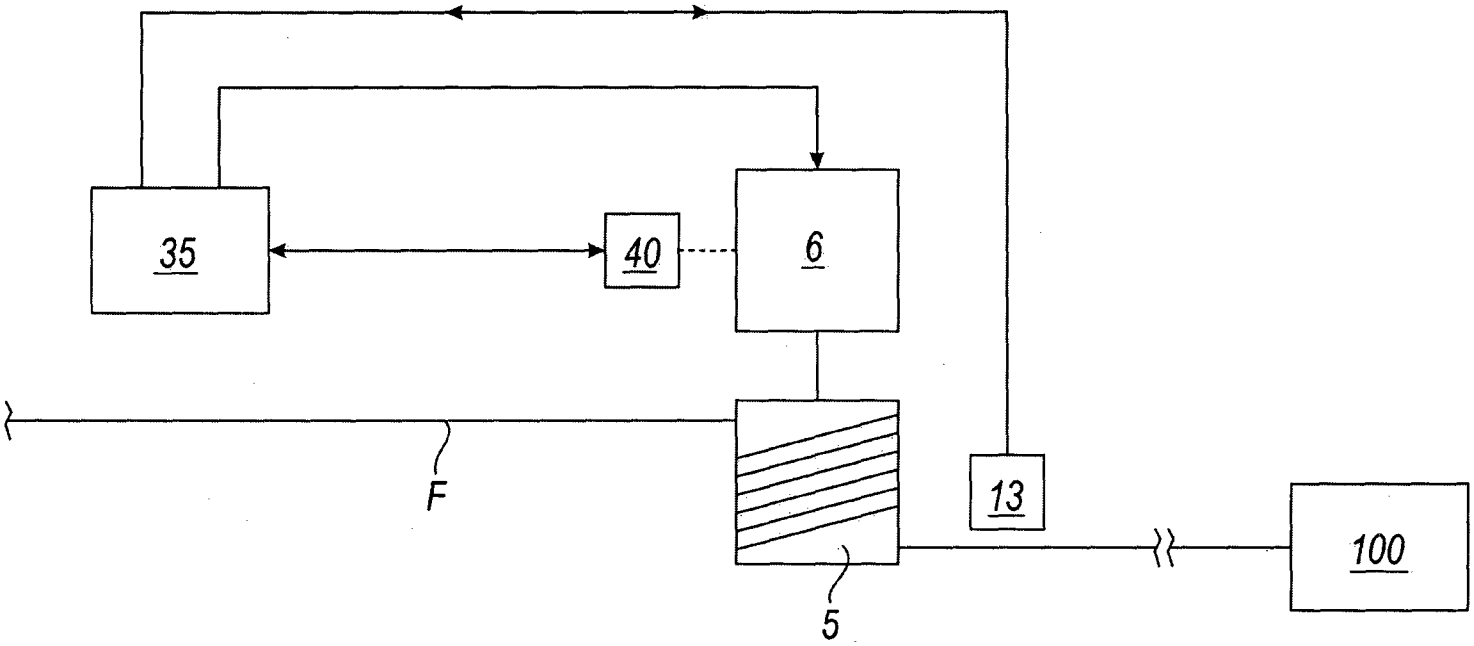
FIG. 3 shows a block diagram of a supply device according to the invention.

The unit 35, in particular, cooperates with a memory unit (not shown) in which there are contained the "physical data" of the rotary drum 5 and i.e. the diameter thereof, the unit 35 drives and also controls the operation of the motor 6 regarding which it thus always knows the speed of rotation through control elements per se known (for example Hall sensors) or encoders or other types of sensors indicated with 40 in FIG. 3.

When using the device 1, the thread F is wound by a corresponding reel (not shown), it passes through the thread guide 10 and the braking member 11, it is wound on the drum 5 from which it is picked up by the textile machine 100. Such supply is controlled in tension and in amount of thread supplied by the control unit 35.

The optical sensor 13 (or an analogous mechanical sensor, such as a wheel, an element for detecting the amount of thread for correlation or of another type and however adapted to measure the amount of thread supplied or picked up or however directed towards the textile machine 100) detects the passage of the thread towards the aforementioned machine, as described in the Italian patent text in the name of the previously mentioned Applicant allowing the unit 35 to identify the amount of thread that passed towards such machine.

The unit 35 also knows the amount of thread that is present on the rotary drum 5 instant by instant; this in that it is known how many times the drum rotates around the longitudinal axis thereof driven by the motor 6, thus picking up the thread from the reel and depositing it on the drum, and the amount of thread that was instead picked up by the textile machine. Thus, comparing the data detected regarding the amount of thread leaving (or about to leave) the drum 5 and the data regarding the amount of thread that is positioned on the latter, the unit 35 may intervene on the motor 6 so that the amount of thread leaving the drum is immediately replaced by a corresponding amount of thread coming from the reel, so as to allow the "reserve" amount of thread present on the drum to be constant.

As known to a man skilled in the art, contrary to the accumulation suppliers, also referred to as negative suppliers, the positive suppliers do not reveal the problem regarding the accumulation or reduction of the number of torsions when supplying a thread; this due to the fact that the speed at which the thread is picked up from the reel through the pulley on which the thread is wound is exactly the same speed that the thread has when directed towards the textile machine. The thread, thus, is not subjected to torsions due to the deposit of the turns on a drum which serves as a reserve.

The supplier subject of the present invention is a negative supplier or a "universal" supplier (i.e. capable of operating, according to the necessities, as positive and negative suppliers), but operating in "negative supplier" mode; such supplier, contrary to the known accumulation suppliers, is capable of supplying a thread without adding or removing torsions from the thread, due to the capacity thereof to accurately know—instant by instant—the amount of thread present on the drum as a reserve and the amount of thread picked up from said reserve by the textile machine.

Thus, as previously described the control unit 35 has the task of maintaining the amount of said "reserve" constant, but being careful, contrary to all suppliers known today, allowing driving the motor 6 and the relative drum 5 only when the textile machine is actually picking up the thread and thus allowing the speed at which the thread is loaded to be substantially equivalent to that at which the textile machine picks up said thread from the drum.

Thus, in practice said supplier (negative or operating in negative mode) providing for loading the drum 5 only when the textile machine is picking up the thread from the reserve and rotating said drum at a speed such that the speed of the supplied thread is exactly equivalent to that of the loaded thread, actually obtains an effect on the thread entirely comparable to that of a positive supplier and thus supplies the thread without adding or removing torsions.

A specific embodiment of the invention has been described. However, other embodiments are possible according to the description above and they shall be deemed falling within the scope of the present invention.

The invention claimed is:

1. A method for supplying thread to a textile machine without creating torsion on the thread, comprising:

picking up the thread from a reel onto a rotary drum driven by an electric motor:

winding the thread supplied by the reel onto the rotary drum driven by the electric motor for a number of drum rotations;

measuring an amount of the thread wound onto the rotary drum based on the number of drum rotations of the rotary drum;

supplying the thread from the rotary drum to the textile machine;

measuring an amount of the thread leaving the rotary drum to supply the textile machine;

comparing the measured amount of the thread wound onto the rotary drum to the measured amount of the thread leaving the rotary drum; and controlling speed of the rotation of the rotary drum by the comparison so the amount of the thread leaving the rotary drum is equivalent to the amount of the thread remaining wound onto the rotary drum to maintain a reserve amount of the thread wound onto the rotary drum to be constant, and thus allowing speed at which the thread is loaded to be substantially equivalent to that at which the textile machine picks up the thread from the drum, to avoid creating the torsion on the thread being supplied to the textile machine.

2. The method according to claim 1, wherein the measuring of the amount of the thread leaving the rotary drum and the measuring of the amount of the thread remaining wound onto the rotary drum occurs simultaneously, this allowing the comparison and then compensating in real time the amount of thread being supplied to the textile machine with a corresponding amount of the thread remaining wound onto the rotary drum.

3. The method according to claim 1, wherein the measuring of the amount of the thread leaving the drum is carried out without contact with the thread.

4. The method according to claim 1, wherein the measuring of the amount of the thread leaving the drum is carried out through direct contact with the thread.

5. The method according to claim 1, wherein the measuring of the amount of the thread wound onto the rotary drum is carried out by controlling the motor which actuates the rotation of the rotary drum to allow the number of rotations of the rotating drum to be determined.

6. The method according to claim 1, wherein the method is alternatively carried out in a negative supplier or by a universal supplier operating in negative mode.

7. The method according to claim 1, wherein the winding of the thread onto the rotary drum driven by the electric motor and supplying the thread to the textile machine is at constant tension and/or quantity.

8. The method of claim 1, wherein:

a) an optical sensor for measuring the amount of the thread leaving the rotary drum, the optical sensor comprising a first part and a second part is provided, the first part is located in a stationary position at an end of the rotating rotary drum when the yarn winds, while the second part is also stationary and is fixed to the body 2 which carries the rotary drum;

b) the optical sensor measuring without contact the amount of thread leaving the rotary drum to be picked up by the textile machine to supply the textile machine;

c) the optical sensor is connected to the control means comprising a control unit which drives and controls the operation of the electric motor which drives the rotary drum;

d) the control unit being input without any direct detection the amount of thread present on the rotary drum instant-by-instant because the control unit controls and being input how many times the rotary drum rotates around its axis, thus picking up the thread from the reel and depositing it on the rotary drum, the control unit also being input the diameter of the drum, so the control unit calculates how much yarn is wound about the rotary drum; and e) the control unit, having calculated the amount of the yarn present on the rotary drum and the yarn which passed between the first part and the second part of the optical sensor, may intervene on motor to control the rotation of the rotary drum so the amount of the yarn or thread leaving the rotary drum is immediately replaced by a corresponding amount of thread coming from the reel.

9. A supply device for providing an accumulation supply of the thread to the textile machine according to the method of claim 1, the device comprising:

the rotary drum adapted to receive from the reel the thread wound onto the drum, the electric motor connected to and driving the rotary drum, thread output measuring means adapted to detect the amount of the thread leaving drum, thread input measuring means adapted to detect the amount of the thread wound onto the rotary drum, control means receiving output signals from the thread input measuring means and thread output measuring means, and adapted to compare the thread input signal with the thread output signal and then control the rotation of the rotary drum so the amount of the thread leaving the rotary drum is immediately compensated by an equivalent amount of the thread wound on the rotary drum picked up from the reel, this allowing the supply device to supply the thread and allow speed at which the thread is loaded to be substantially equivalent to that at which the textile machine picks up the thread from the drum, without creating torsion on the thread to the textile machine.

10. The device according to claim 9, wherein the thread output measuring means are measuring means which measure the amount of the thread leaving the rotary drum through direct contact with the rotary drum or, alternatively, the thread output measuring means are remote measuring means selected from the group consisting of an optical sensor and a correlation sensor, which measure the amount of thread leaving the rotary drum without having direct contact with such thread.

11. The device according to claim 9, wherein the thread input measuring means are measuring means for the indirect measurement of the amount of thread wound on the rotary drum; such measurement allowing the control means to precisely recover the amount of thread wound on the drum.

12. The device according to claim 9, which is alternatively a supply device of the universal type operating in negative mode or a negative accumulation supply device.

13. The device according to claim 9, wherein the output measuring means are measuring means comprising a rotary member, which measures the amount of the thread leaving the rotary drum through direct contact with the rotary drum or, alternatively, the output measuring means are remote measuring means comprising as an optical sensor or a correlation sensor, which measure the amount of thread leaving the rotary drum without having direct contact with such thread.

14. The device according to claim 9, wherein the means for the measurement of the amount of thread wound on the rotary drum comprise a Hall sensor or an encoder adapted to measure the number of rotations or fraction of rotation of the electric motor which moves the rotary drum; and the control means comprises a microprocessor control unit to precisely recover the amount of thread wound on the drum.

* * * * *